US008911072B2

(12) United States Patent
Ohba

(10) Patent No.: US 8,911,072 B2
(45) Date of Patent: Dec. 16, 2014

(54) PRE-APPLYING LIQUID APPLYING APPARATUS FOR INKJET PRINTER AND IMAGE FORMING SYSTEM

(75) Inventor: Tetsuya Ohba, Ibaraki (JP)

(73) Assignee: Ricoh Company, Ltd., Tokyo (JP)

( * ) Notice: Subject to any disclaimer, the term of this patent is extended or adjusted under 35 U.S.C. 154(b) by 159 days.

(21) Appl. No.: 13/409,692

(22) Filed: Mar. 1, 2012

(65) Prior Publication Data

US 2012/0229580 A1 Sep. 13, 2012

(30) Foreign Application Priority Data

Mar. 9, 2011 (JP) ..... 2011-052010
Oct. 3, 2011 (JP) ..... 2011-219222

(51) Int. Cl.
*B41J 2/01* (2006.01)
*B41J 2/015* (2006.01)
*B41J 11/00* (2006.01)

(52) U.S. Cl.
CPC ..... *B41J 11/0015* (2013.01)
USPC ..... 347/101; 347/103; 347/21

(58) Field of Classification Search
CPC .... B41J 2/2114; B41J 11/0015; B41J 2/0057; B41J 2/01; B41J 11/007; B41J 11/06; B41J 2202/02; B41J 2/14; B41J 2/16552; B41J 2/185; B41J 2/17513; B41J 2/175
USPC ..... 347/101, 103, 104, 21, 28, 32, 36, 84, 347/85, 89
See application file for complete search history.

(56) References Cited

U.S. PATENT DOCUMENTS

| | | | | | |
|---|---|---|---|---|---|
| 3,640,203 | A * | 2/1972 | Raab et al. | 396/608 |
| 3,647,525 | A * | 3/1972 | Dahlgren | 427/428.15 |
| 3,973,491 | A * | 8/1976 | Porth et al. | 101/124 |
| 4,297,967 | A * | 11/1981 | Osta | 118/117 |
| 4,359,963 | A * | 11/1982 | Saito et al. | 118/60 |
| 4,385,559 | A * | 5/1983 | Jarach | 101/148 |
| 4,872,406 | A * | 10/1989 | Kusch | 101/148 |
| 4,887,547 | A * | 12/1989 | Sommer et al. | 118/410 |
| 5,008,690 | A * | 4/1991 | Koizumi et al. | 346/140.1 |
| 5,022,322 | A * | 6/1991 | Keller | 101/148 |
| 5,191,835 | A * | 3/1993 | Blanchard | 101/148 |
| 6,236,825 | B1 * | 5/2001 | Takeuchi | 399/237 |
| 6,796,228 | B2 * | 9/2004 | Goodwin et al. | 101/148 |
| 8,191,503 | B2 * | 6/2012 | Kusunoki | 118/681 |

(Continued)

FOREIGN PATENT DOCUMENTS

| | | |
|---|---|---|
| JP | 05204271 A * | 8/1993 |
| JP | 2008-260307 | 10/2008 |
| JP | 2010-158602 | 7/2010 |

OTHER PUBLICATIONS

Machine Translation for Iwasaki et al (JP Pat 2008-260307A).*

*Primary Examiner* — Laura Martin
*Assistant Examiner* — Leonard S Liang
(74) *Attorney, Agent, or Firm* — Cooper & Dunham LLP

(57) ABSTRACT

A pre-applying liquid applying apparatus for an inkjet printer is disclosed. The apparatus includes an applying roller which applies a treatment agent onto a recording medium before an image is formed; a squeeze roller which abuts against the applying roller; and a treatment agent supplying unit which supplies the treatment agent to a nip portion of the applying roller and the squeeze roller. A squeeze pressure adjusting mechanism is provided which adjusts an abutting force of the squeeze roller against the applying roller.

11 Claims, 10 Drawing Sheets

(56) References Cited

U.S. PATENT DOCUMENTS

| | | | | |
|---|---|---|---|---|
| 8,262,216 | B2 * | 9/2012 | Hamano et al. | 347/103 |
| 8,302,555 | B2 * | 11/2012 | Nakazawa et al. | 118/262 |
| 2003/0165630 | A1 * | 9/2003 | Baker et al. | 427/428 |
| 2004/0135860 | A1 * | 7/2004 | Williams | 347/96 |
| 2005/0179720 | A1 * | 8/2005 | Iwasaki et al. | 347/19 |
| 2007/0098422 | A1 * | 5/2007 | Asakura et al. | 399/44 |
| 2007/0103531 | A1 * | 5/2007 | Jones et al. | 347/103 |
| 2007/0285486 | A1 * | 12/2007 | Harris et al. | 347/103 |
| 2009/0153635 | A1 * | 6/2009 | Park et al. | 347/103 |
| 2010/0231674 | A1 * | 9/2010 | Domoto et al. | 347/103 |
| 2011/0100242 | A1 * | 5/2011 | Krueger et al. | 101/365 |

* cited by examiner

PRE-APPLYING LIQUID APPLYING APPARATUS FOR INKJET PRINTER AND IMAGE FORMING SYSTEM

TECHNICAL FIELD

The present invention relates to an pre-applying liquid applying apparatus for an inkjet printer, in which pre-applying liquid applying apparatus a treatment agent (below called pre-applying liquid) such as a blur suppressing agent which suppresses an image blur of the inkjet printer which ejects ink droplets and which forms an image on a recording medium is applied onto the recording medium prior to image forming; and an image forming system.

BACKGROUND ART

FIG. 8 is a flowchart which shows a flow of an image forming system which includes an inkjet printer and a pre-applying liquid applying apparatus.

As shown, a recording medium W which includes an elongated continuous paper sheet, for example, which is sent out from a roll 31 is initially sent into a pre-applying liquid applying apparatus 32, and pre-processing is performed with a pre-applying liquid such as the above-described suppressing agent being applied onto the recording medium W. The system is arranged such that, next, the processed recording medium W is sent into an inkjet printer 33, onto which recording medium W ink droplets are ejected, so that a desired image is formed, and then it is sent to a post-processing apparatus (not shown), so that predetermined post-processing is performed.

FIG. 9 is an overview configuration diagram of a related-art pre-applying liquid applying apparatus for an inkjet printer.

As shown, a transfer roller 1, a peripheral face of which is covered with an elastic body such as rubber, is rotatably supported via a bearing at one end of an oscillatable TR arm 2, a TR spring 3 is connected to the other end of the TR arm 2, and a base end of the TR spring 3 is fixed to a frame. A tensile force of this TR spring 3 acts in such a direction as to oscillate the TR arm 2 to push the transfer roller 1 to the applying roller 5 side.

A TR cam 4 is in contact with the TR arm 2 and has attached a motor (not shown) which rotates the TR cam 4 and an angular sensor (not shown) which detects a rotational position of the TR cam 4. Such a rotation of the TR cam 4 makes it possible to oscillate the TR arm 2 against the tensile force of the TR spring 3 as described above, and move the transfer roller 1 in a direction away from the applying roller 5.

A peripheral face of this applying roller 5 is covered with an elastic body such as rubber, and the applying roller 5 is rotationally driven in an arrow direction by a motor 6. A squeeze roller 7, which abuts against the applying roller 5, is arranged such that it rotates with the applying roller 5.

This squeeze roller 7 is rotatably supported via a bearing at one end of a SQZ arm 8 which is oscillatable; a SQZ spring 9 is connected to the other end of the SQZ arm 8; and a base end of the SQZ spring 9 is fixed to a frame. A tensile force of the SQZ spring 9 acts in such a direction as to oscillate the SQZ arm 8 to push the squeeze roller 7 to the applying roller side 5.

A SQZ cam (OC) 10 is in contact with the SQR arm 8 and has attached a motor (not shown) which rotates the SQZ cam (OC) 10 and an angular sensor (not shown) which detects a rotational position of the SQZ cam (OC) 10. Such a rotation of the SQZ cam (OC) 10 may oscillate the SQZ arm 8 against the tensile force of the SQZ spring 9 as described above, and move the squeeze roller 7 in a direction away from the applying roller 5.

Pre-applying liquid 12 is contained inside a case 11 which tucks in the applying roller 5 and the squeeze roller 7. The case 11 is arranged as a container which is made airtight such that the pre-applying liquid 12 does not leak out of the case, and a water level of the pre-applying liquid 12 is maintained constant.

At a portion which opposes the transfer roller 1 of the case 11 is provided an opening portion, at which opening portion a shutter 13 for suppressing evaporation of moisture of the pre-applying liquid 12 is provided such that it can open and close. The shutter 13 is arranged to open when the transfer roller 1 contacts the applying roller 5.

The water level of the above-described pre-applying liquid 12 is monitored with a water-level sensor 14, so that when the water level becomes low, a supply valve 15 is opened and a supply pump 16 is driven to send the pre-applying liquid 12 within a pre-applying liquid tank 17 into the case 11. The supply valve 15 is closed when a desired water level is reached to stop the supply pump 16, thereby maintaining the water level of the pre-applying liquid 12 within the case 11 constant.

The squeeze roller 7 is positioned such that it soaks in the pre-applying liquid 12; the squeeze roller 7 is arranged such that the applying roller 5 is rotated by the motor 6, so that the applying roller 5 rotates with the squeeze roller 7, making it possible to supply the pre-applying liquid 12 to a nip position of the squeeze roller 7 and the applying roller 5 due to viscosity of the pre-applying liquid 12.

The pre-applying liquid 12 passes through a nip portion of the above-described applying roller 5 and the squeeze roller 7, and forms a layer of the pre-applying liquid 12 in a uniform minute amount on a surface of the applying roller 5. The recording medium W such as a sheet of paper is pushed against the applying roller 5 by the transfer roller 1, so that the pre-applying liquid 12 in the uniform minute amount is transferred onto the recording medium W for applying. The present apparatus configuration makes it possible to achieve uniform minute amount applying of the pre-applying liquid 12 onto the recording medium W.

Moreover, taking into account characteristic degradation due to thickening of the pre-applying liquid 12, a liquid-discharge valve 18, a liquid-discharge pump 19, and a liquid-discharge tank 20 are provided in order to discharge the pre-applying liquid 12. The liquid-discharge valve 18 is opened and the liquid-discharge pump 19 is driven, so that the pre-applying liquid 12 within the case 11 that is degraded is discharged to the liquid-discharge tank 20.

A related-art pre-applying liquid applying apparatus for the inkjet printer is disclosed in Patent document 1,for example.

PATENT DOCUMENT

Patent Document 1: JP2008-260307A

FIG. 10 is a characteristic diagram showing a relationship between a surface speed of the applying roller 5 and a pre-applying liquid amount applied onto the recording medium W when a surface speed (the number of rotations) of the applying roller 5, while maintaining a load for pushing the squeeze roller 7 against the applying roller 5 constant.

Moreover, FIG. 11 is a characteristic diagram showing a relationship between a load (a squeeze pressure) for pushing the squeeze roller 7 against the applying roller 5 and a pre-applying liquid amount applied onto the recording medium W when the load (the squeeze pressure) for pushing the squeeze roller 7 against the applying roller 5 is changed while maintaining the surface speed (the number of rotations) of the applying roller 5 constant.

FIGS. 10 and 11 show a range in which a variation among a minimum value, an average value, and a maximum value of the pre-applying liquid applying amount becomes large.

As evident from the results in FIG. 10, the faster the surface speed of the applying roller 5, the larger is the pre-applying liquid applying amount. Moreover, as evident from the results in FIG. 11, the pre-applying liquid applying amount tends to decrease when the load (the squeeze pressure) for pushing the squeeze roller 7 against the applying roller 5 of the squeeze roller 7 becomes large.

Based on the results of FIGS. 10 and 11, it can be said that, in other words, the pre-applying liquid amount applied onto the recording medium W of the present applying apparatus mainly changes depending on the "viscosity of the pre-applying liquid 12", the "surface speed of the applying roller 5", and the "the load (the squeeze pressure) for pushing the squeeze roller 7 against the applying roller 5". This is established by equilibrium between a force due to the viscosity of the pre-applying liquid 12 and a roller nip force between the applying roller 5 and the squeeze roller 7.

In high-speed conveying of the recording medium W which includes an elongated continuous paper sheet, etc., an accelerating region which increases a conveying speed exists at the time of starting the apparatus and a decelerating region which decreases the conveying speed exists at the time of stopping the apparatus. Then, in order to maintain running stability of the recording medium W in the high-speed conveying, the pre-applying liquid applying apparatus is specified such that it is adjusted to make it possible to perform optimum applying at the time of high-speed conveying. On the other hand, as shown in FIG. 10 as described above, when the surface speed of the applying roller 5 is slow, an amount of applying the pre-applying liquid 12 onto the recording medium W becomes small, so that the amount of applying the pre-applying liquid at times of acceleration and deceleration of the pre-applying liquid applying apparatus becomes smaller relative to the amount of applying at a time of normal printing, leading to a decreased effect of pre-applying in the regions. As a result, there is a problem that an ink blur appears on the recording medium W, so that image quality is degraded.

Therefore, in a range in which the conveying speed of the recording medium W is slow, or, in other words, at the times of acceleration and of deceleration of the apparatus, it is necessary to make the load (the squeeze pressure) for pushing the squeeze roller 7 against the applying roller 5 small to secure the amount of applying; however, as shown in FIG. 11, in a region in which the squeeze pressure is low, a variation of the amount of applying is large, leading to difficulties in providing the recording medium W with a desired performance.

In this way, in a case in which it becomes necessary to apply in a region with a large variation with a low printing speed, it may not be possible to deal with the case merely by making the load (the squeeze pressure) for pushing the squeeze roller 7 against the applying roller 5 small.

On the other hand, there is a problem of lacking versatility; this is because, when it is desired to change the printing speed itself, it becomes necessary to change the specification of the pre-applying liquid applying apparatus, so that it becomes necessary to set the squeeze pressure again and the above-described SQZ spring 9 is exchanged in order to achieve an optimal squeeze pressure for the change in the printing speed.

DISCLOSURE OF THE INVENTION

In light of the problems of the related art as described above, an object of the present invention is to provide a pre-applying liquid applying apparatus for an inkjet printer that makes it possible to perform a proper treatment on a recording medium and to provide an image forming apparatus, wherein a proper treatment is performed, so that a high-quality image is obtained.

According to an embodiment of the present invention, a pre-applying liquid applying apparatus for an inkjet printer is provided, including an applying roller which applies a treatment agent onto a recording medium before an image is formed; a squeeze roller which abuts against the applying roller; and a treatment agent supplying unit which supplies the treatment agent to a nip portion of the applying roller and the squeeze roller, wherein a squeeze pressure adjusting mechanism is provided which adjusts an abutting force of the squeeze roller against the applying roller.

Embodiments of the present invention that are arranged as described above make it possible to provide a pre-applying liquid applying apparatus for an inkjet printer that can perform a proper treatment on a recording medium, and an image forming system, wherein a proper treatment is performed, so that a high-quality image is obtained.

BRIEF DESCRIPTION OF THE DRAWINGS

Other objects, features, and advantages of the present invention will become more apparent from the following detailed descriptions when read in conjunction with the accompanying drawings, in which.

BEST MODE FOR CARRYING OUT THE INVENTION

Embodiments of the present invention that are arranged as described above make it possible, first, to make the squeeze pressure variable, making it possible to secure an optimal squeeze pressure for various printing speeds. Moreover, they make it possible to secure an optimal squeeze pressure even in accelerating and decelerating regions of a pre-applying liquid applying apparatus.

Moreover, as they are provided with a buffer mechanism for conveying a recording medium, conveying is not performed for a speed with a variation of a pre-applying liquid applying amount due to a too-low squeeze pressure, making it possible to start applying at a time a speed is reached at which an optimal applying amount is obtained. Furthermore, they have advantageous features such as being able to also deal with a printing speed in a region with a large applying performance variation with a low printing speed.

Next, each embodiment of the pre-applying liquid applying apparatus according to the present invention is described with reference to the drawings.

(Embodiment 1)

Figure 1:
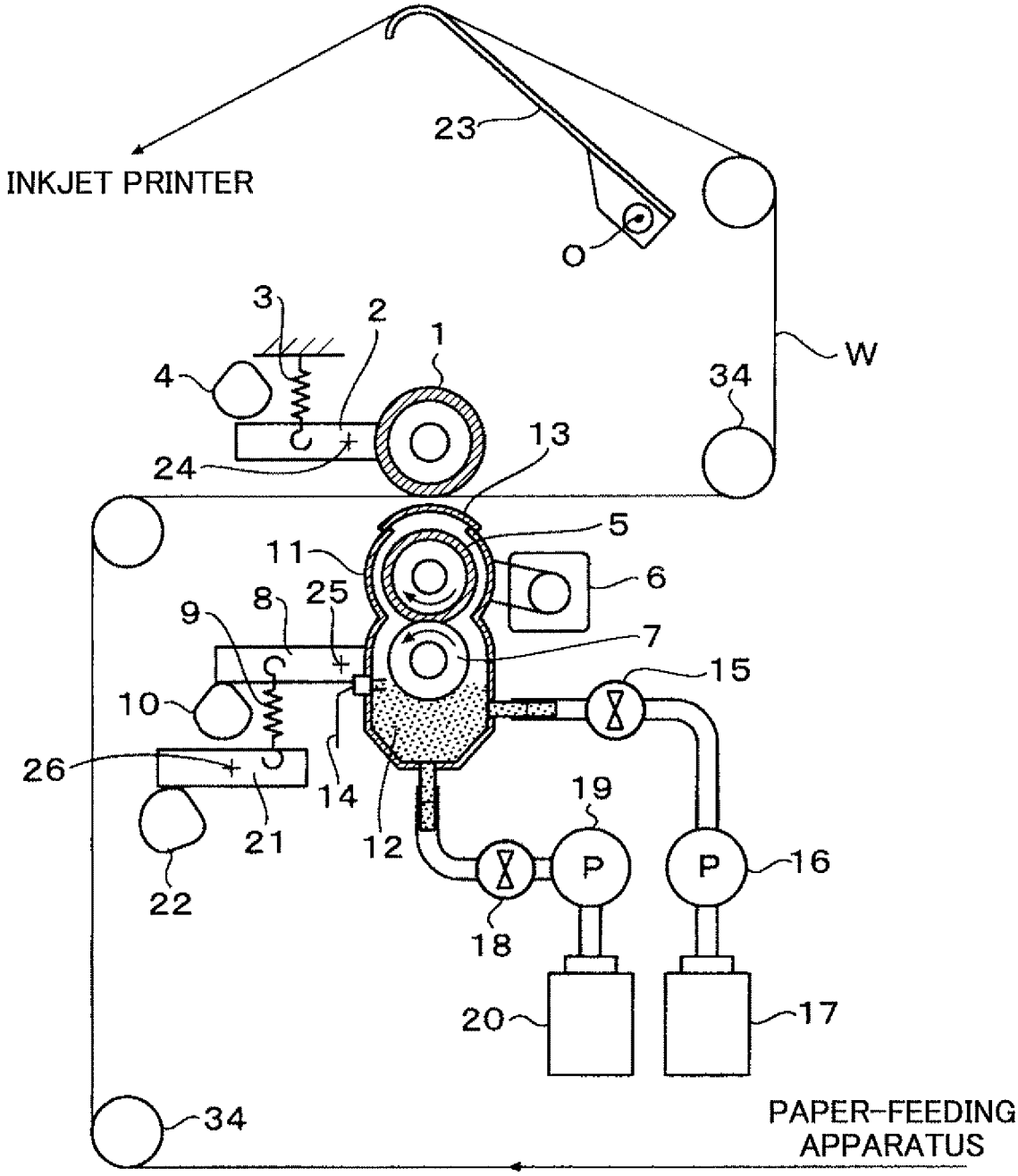
FIG. 1 is a schematic configuration diagram of a pre-applying liquid applying apparatus according to an embodiment 1 of the present invention.

FIG. 1 is a schematic configuration diagram of the pre-applying liquid applying apparatus according to an embodiment 1 of the present invention.

As shown, a transfer roller 1 is supported at one end of a TR arm 2, a TR spring 3 is connected to the other end of the TR arm 2, and the transfer roller 1 is elastically energized to the applying roller 5 side with the tensile force. An oscillating supporting point 24 of the TR arm 2 is provided at an intermediate position of the TR arm 2. Moreover, a TR cam 4, which is in contact with the other end on the opposite side of the transfer roller 1 of the TR arm 2, has a function of separating the transfer roller 1 from the applying roller 5 against the tensile force of the TR spring 3 with a rotation of the TR cam 4.

A squeeze roller 7 abuts against the applying roller 5. The squeeze roller 7 is supported at one end of a SQZ arm 8, the other end of which SQZ arm 8 is connected a SQZ spring 9, whose tensile force elastically energizes the squeeze roller 7 to the applying roller 5 side. An oscillating supporting point 25 of the SQZ arm 8 is provided at an intermediate position of the SQZ arm 8.

Moreover, a SQZ cam (OC) 10, which is in contact with the other end on the opposite side of the squeeze roller 7 of the SQZ arm 8, has a function of separating the squeeze roller 7 from the applying roller 5 against a tensile force of the SQZ spring 9 with a rotation of the SQZ cam (OC) 10.

A pre-applying liquid 12 is contained inside a case 11, which encloses the above-described applying roller 5 and the squeeze roller 7, and whose water level is maintained constant.

At a portion, which opposes the transfer roller 1, of the case 11 is provided an opening portion covered by a shutter 13 for suppressing evaporation of moisture of the pre-applying liquid 12, which shutter 13 is provided such that it can open and close. The shutter 13 is arranged to open when the transfer roller 1 comes into contact with the applying roller 5.

The water level of the above-described pre-applying liquid 12 is monitored with a water-level sensor 14, so that, when the water level becomes low, a supply valve 15 is opened and a supply pump 16 is driven to send the pre-applying liquid 12 within a pre-applying liquid tank 17 into the case 11. The supply valve 15 is closed when a desired water level is reached to stop the supply pump 16, thereby maintaining a constant water level of the pre-applying liquid 12 within the case.

The squeeze roller 7, which is positioned such that it soaks in the pre-applying liquid 12, is arranged such that the applying roller 5 is rotated by a motor 6, so that the applying roller 5 rotates with the squeeze roller 7, making it possible to supply the pre-applying liquid 12 to a nip position of the squeeze roller 7 and the applying roller 5 due to viscosity of the pre-applying liquid 12.

The pre-applying liquid 12 passes through the nip portion of the above-described applying roller 5 and the squeeze roller 7, and forms a layer of a uniform minute amount of the pre-applying liquid 12 on a surface of the applying roller 5. The recording medium W such as a sheet of paper is pushed against the applying roller 5 by the transfer roller 1, so that the pre-applying liquid 12 is transferred and applied onto the recording medium W.

A material of the pre-applying liquid 12 is appropriately selected, taking into account, for example, components of ink used for an inkjet printer, and a material of the recording medium W.

A base end of the SQZ spring 9 is connected to one end of an oscillatable ADJ arm 21. An ADJ cam 22 is in contact with the other end of the ADJ arm 21, to which ADJ cam 22 is attached an angular sensor (not shown) which detects a rotational position and a motor (not shown); rotational driving of the ADJ cam 22 makes it possible to control an oscillating angle of the ADJ arm 21.

A spring force generated by the SQZ spring 9 changes depending on the oscillating angle of the ADJ arm 21, making it possible, as a result, to control the squeeze pressure of the squeeze roller 7 against the applying roller 5. According to the present embodiment, the squeeze pressure is controlled such that it becomes almost proportional to the conveying speed of the recording medium W within the pre-applying liquid applying apparatus. An oscillating supporting point 26 of the ADJ arm 21 is provided at an intermediate position of the ADJ arm 21.

As shown in FIG. 1, the SQZ arm 8 and the ADJ arm 21 are provided in parallel such that one end of the ADJ arm 21 is arranged near the other end with which the SQZ cam (OC) 10 of the SQZ arm 8 is in contact, and the SQZ spring 9 which includes an extension spring is installed between the other end of the SQZ arm 8 and the one end of the ADJ arm 21.

Figure 2:
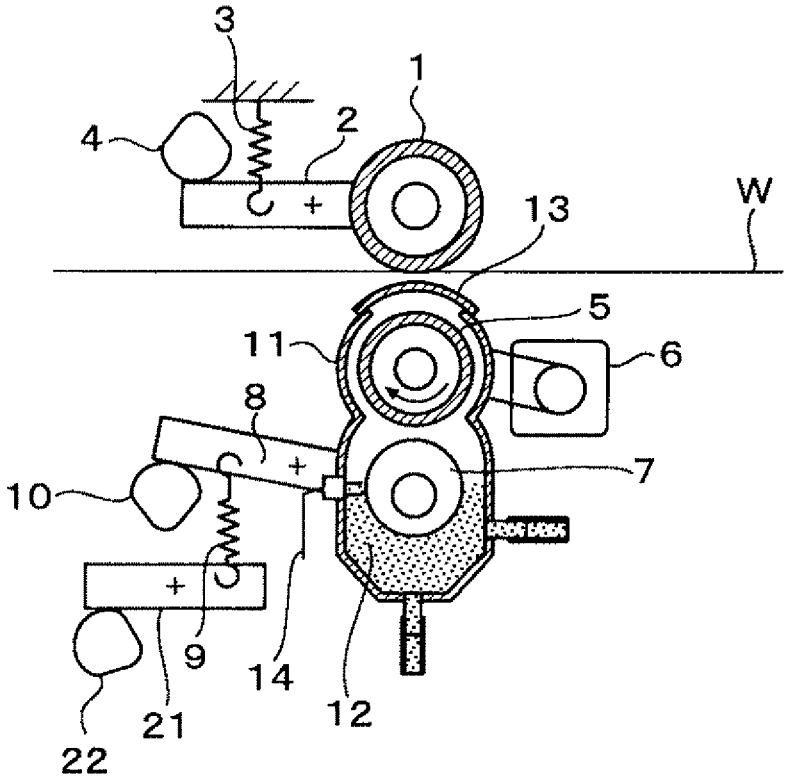
FIG. 2 is a schematic configuration diagram which shows that a squeeze roller is separated from an applying roller at a time applying of the pre-applying liquid applying apparatus is stopped.

When a nip (an abutted state) of the applying roller 5 and the squeeze roller 7 is left as it is for a long period of time without releasing, surfaces of the squeeze roller 7 and the applying roller 5 could change in quality due to the pre-applying liquid 12 which is accumulated in the nip portion. Therefore, at the time the applying is stopped, the SQZ cam (OC) 10 is rotated to separate the squeeze roller 7 from the applying roller 5 as shown in FIG. 2.

Figure 3:
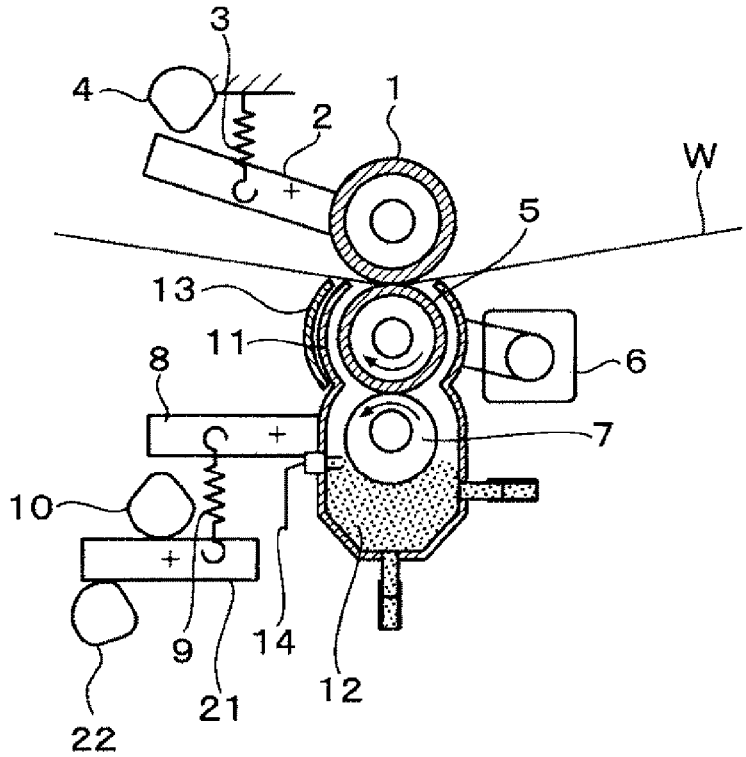
FIG. 3 is a schematic configuration diagram of a mechanism which adjusts a squeeze pressure of the squeeze roller against the applying roller.

FIG. 3 is a schematic configuration diagram of a mechanism which adjusts a squeeze pressure of the squeeze roller 7 against the applying roller 5. As the squeeze roller 7 is abutted against the applying roller 5 with a spring force of the SQZ spring 9, rotating the SQZ cam (OC) 10 yields a positional relationship as shown in FIG. 3.

An abutting force of the squeeze roller 7 against the applying roller 5 is determined by the spring force of the SQZ spring 9. Then, it is arranged such that the ADJ cam 22 is rotated to oscillate the ADJ arm 21 to adjust an extending state of the SQZ spring 9, thereby controlling the squeeze pressure.

Rotating the ADJ cam 22 in a direction such that the SQZ spring 9 is extended increases the squeeze pressure, while, conversely, rotating the ADJ cam 22 in a direction such the SQZ spring 9 is contracted decreases the squeeze pressure.

If the conveying speed of the recording medium W is yet low (see accelerating regions D-F in FIG. 5) after starting applying of the pre-applying liquid 12 with the squeeze pressure adjusting mechanism, the ADJ cam 22 is rotated to contract the SQZ spring 9 to decrease the squeeze pressure, supplying a sufficient amount of pre-applying liquid 12 for the applying roller 5.

The ADJ cam 22 is rotated in a direction (a direction which is a direction opposite the above-described direction) such that the squeeze pressure becomes high in conjunction with an increased conveying speed of the recording medium W to extend the SQZ spring 9, so that an amount of applying is adjusted for the applying roller 5. In this way, the squeeze pressure is adjusted, making it possible to eliminate the dependence of the pre-applying liquid applying amount on the conveying speed.

While not shown, connected to the ADJ cam 22 is a stepping motor which reversibly rotates the ADJ cam 22 in a desired direction, and, further, the ADJ cam 22 is provided with an angular sensor which detects the rotational position of the ADJ cam 22.

Therefore, the squeeze pressure adjusting mechanism according to the present embodiment mainly includes the SQZ spring 9; the ADJ arm 21; the ADJ cam 22; the motor which rotates the ADJ cam 22; and the angular sensor which detects the rotational position of the ADF cam 22.

Figure 4:
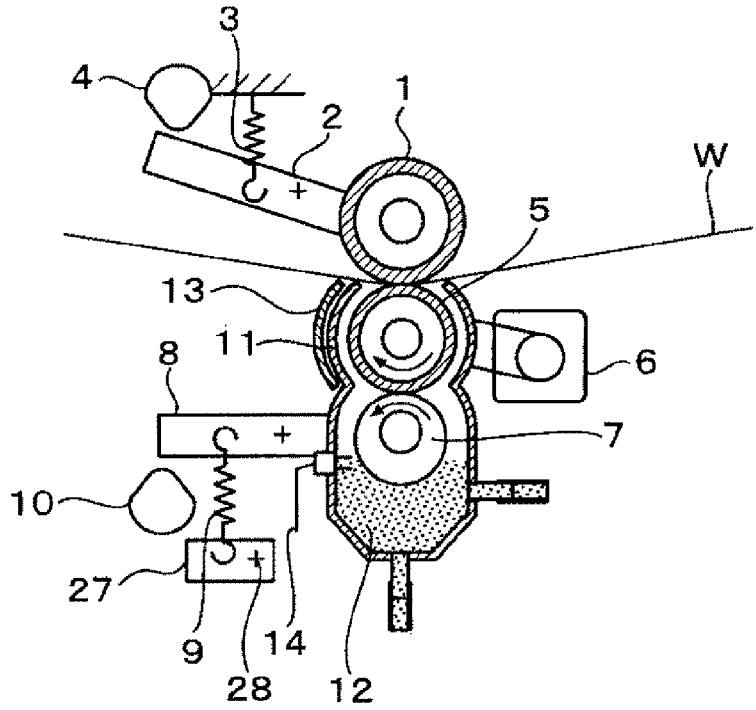
FIG. 4 is a diagram illustrating a variation of the mechanism which adjusts the squeeze pressure.

FIG. 4 is a schematic configuration diagram illustrating a variation of the squeeze pressure adjusting mechanism.

As shown, the mechanism is arranged such that a motor (not shown) which circularly moves the ADJ arm 27 around the supporting point 28, with one end of the SQZ spring 9 being attached to the ADJ arm 27 and an angular sensor (not shown) which detects the rotational position of the ADJ arm 27, adjusts the force exerted by the SQZ spring 9, thereby adjusting the squeeze pressure.

Therefore, the squeeze pressure adjusting mechanism according to the present variation mainly includes the SQZ spring 9; the ADJ arm 27; the motor which rotates the ADJ arm 27; and the angular sensor which detects the rotational position of the ADF arm 27.

Returning to FIG. 1 again, on the downstream side of a recording medium conveying direction (arrowed direction) of the transfer roller 1 is provided a buffer mechanism 23 which may circularly move with one point as a rotational center 0 such that it is in elastic contact with the recording medium W, so that a conveying path of the recording medium W changes depending on an oscillating angle of the buffer mechanism 23.

Figure 8:
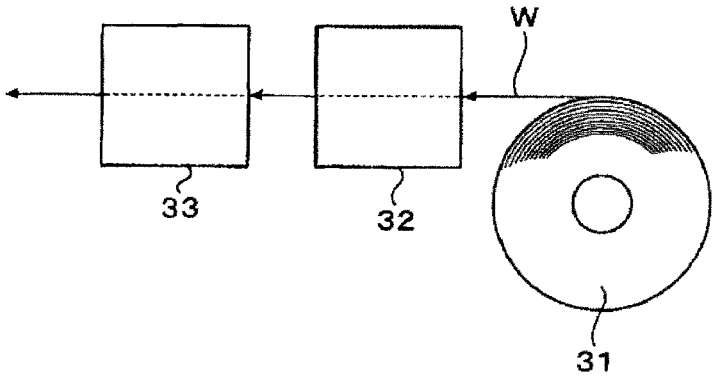
FIG.8 Prior Art
FIG. 8 is a flowchart which shows a flow of an image forming system which includes an inkjet printer and the pre-applying liquid applying apparatus.
Figure 9:
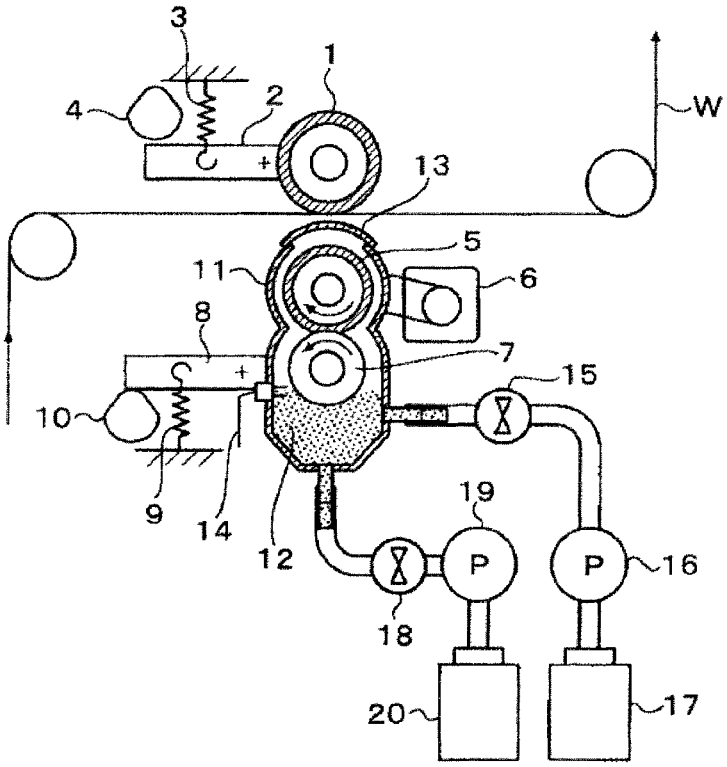
Prior Art FIG.9
FIG. 9 is a schematic configuration diagram of a related-art pre-applying liquid applying apparatus for an inkjet printer.
Figure 10:
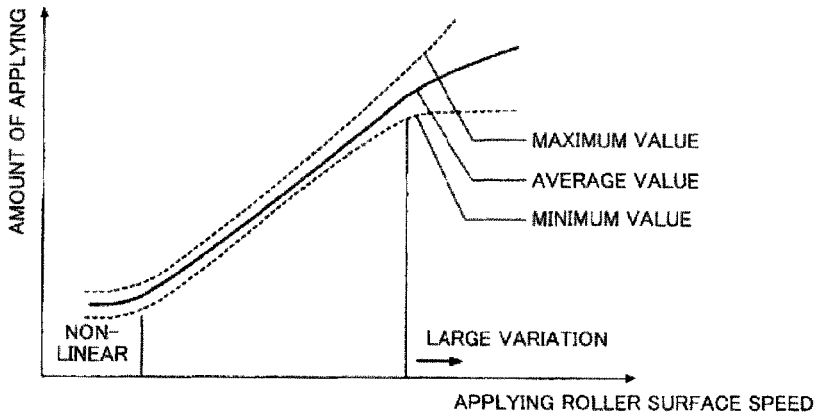
FIG.10 Prior Art
FIG. 10 is a characteristic diagram showing a relationship between a surface speed of the applying roller and a pre-applying liquid amount applied onto the recording medium when the surface speed of the applying roller is changed while maintaining a load for pushing the squeeze roller against the applying roller constant.

The recording medium W is sent out of a paper-supplying apparatus which includes the roll 31 (see FIG. 8), and passes through a nip portion of the transfer roller 1 and the applying roller 5 via multiple guide rollers 34 as shown in FIG. 1, so that the pre-applying liquid 12 is applied onto the recording medium W, and, subsequently the recording medium W is sent to the following inkjet printer 33 (see FIG. 8) while having its path adjusted by the buffer mechanism 23.

Figure 5:
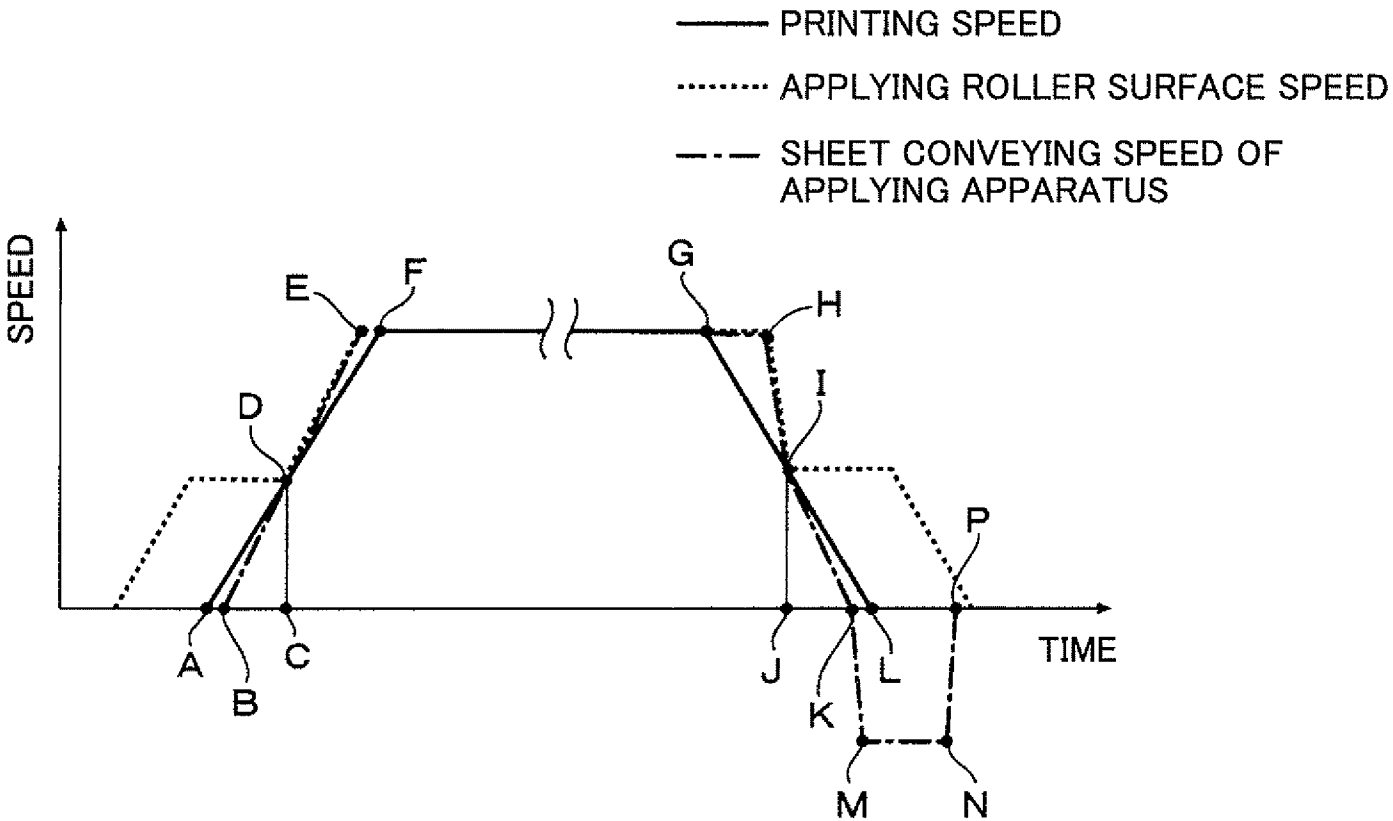
FIG. 5 is a diagram for explaining an exemplary operation of the pre-applying liquid apparatus according to the present embodiment.

FIG. 5 is a diagram for describing an operation of the pre-applying liquid apparatus according to the present embodiment.

A solid line represents a print speed of the inkjet printer 33 (see FIG. 8) which follows the pre-applying liquid applying apparatus 32, a broken line represents a surface speed of the applying roller 5 within the pre-applying liquid applying apparatus 32, and a dashed line represents a conveying speed of the recording medium W within the pre-applying liquid applying apparatus 32.

Within time points (below abbreviated as points) C to J, the conveying speed (shown in the dashed line) of the recording medium W is the same speed as the surface speed (shown in the broken line) of the applying roller 5, so that the dashed line and the broken line are overlapped.

As shown in the broken line in FIG. 5, the applying roller 5 starts driving before printing is started. At this time, the SQZ cam (OC) 10 is rotated and, in conjunction, the squeeze roller 7 is abutted against by the applying roller 5, rotates with the applying roller 5, and the pre-applying liquid 12 is applied to the applying roller 5 and the squeeze roller 7. Then, when a point D is reached, the ADJ cam 22 is rotated to control the squeeze pressure to an optimal level, standing by while opening the shutter 13 on the case 11.

At a point A, the inkjet printer 33 starts conveying the recording medium W prior to conveying of the recording medium W within the pre-applying liquid applying apparatus 32. When a point B is reached, conveying of the recording medium W is started with a recording medium conveying mechanism (not shown) within the pre-applying liquid applying apparatus 32. At the same time, the TR cam 4 is rotated, the transfer roller is abutted against the applying roller 5 to place the recording medium W between the transfer roller 1 and the applying roller 5, so that the pre-applying liquid 12 is applied onto the recording medium W and the recording medium W is conveyed. The point C is a point of starting applying of the pre-applying liquid 12.

Now, a shortage of the recording medium W occurs by an amount corresponding to an area surrounded by points A, B, and D, which is a difference of an amount (an amount of sheet conveyed by the inkjet printer 33) corresponding to an area surrounded by the point A, C, and D and an amount (an amount of sheet conveyed by the pre-applying liquid applying apparatus 32) corresponding to an area surrounded by the point C, B, and D, so that a tension force becomes large, which could lead to snapping of the recording medium W. Thus, it is arranged such that the above-described difference is absorbed by a difference in a path change due to circular movement of the buffer mechanism 23.

With the point D to point E line showing an accelerating region of the applying roller 5 and the point D to point F line showing an accelerating region of the printing speed within the inkjet printer 33, the surface speed of the applying roller 5 may exceed the printing speed of the inkjet printer 33. In this case, an excessive amount of the recording medium W is sent in an amount corresponding to an area surrounded by points D, E, and F, which excessive amount is absorbed by the buffer mechanism 23, making it possible to convey the recording medium W without slack.

Between the point F and the point G, the printing speed of the inkjet printer 33, the surface speed of the applying roller 5 within the pre-applying liquid applying apparatus 32, and a conveying speed of the recording medium W match, so that applying of the pre-applying liquid 12 onto the recording medium W and printing onto the recording medium W are continuously performed.

While decreasing the printing speed of the inkjet printer 33 is started at the point G, conveying of the recording medium W within the pre-applying liquid applying apparatus 32 and applying of the pre-applying liquid 12 are performed continuously. Then, the applying roller 5 starts decreasing the speed at a point H, applying of the pre-applying liquid 12 is stopped at a point I, and then, conveying of the recording medium W within the pre-applying liquid applying apparatus 32 is stopped at the time the point K is reached, and driving of the inkjet printer 33 is stopped at a point L.

An area surrounded by the points G, H, and I corresponds to an excessively sent amount of the recording medium W onto which the pre-applying liquid 12 is applied from the time a speed decrease of the printing speed is started to the time applying of the pre-applying liquid 12 is stopped, which excessive amount is stored in the buffer mechanism.

An amount of an area surrounded by points I, J, and K corresponds to an amount that conveying of the recording medium W is performed without the pre-applying liquid 12 being applied, which amount corresponding to an excess amount is also accumulated in the buffer mechanism 23; however, the excess amount of recording medium W onto which the pre-applying liquid 12 is not applied needs to be returned to the applying roller 5 side.

Figure 6A:
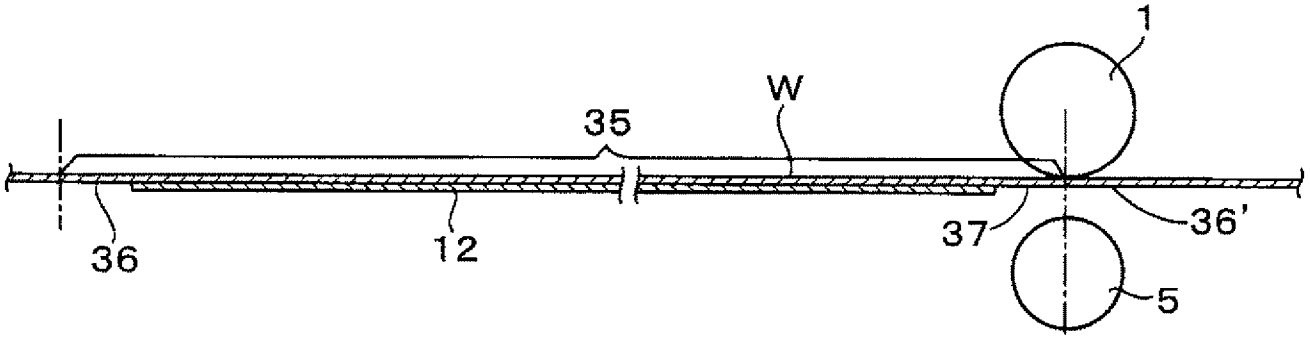
FIGS. 6A and 6B are views for explaining a return amount of the recording medium with FIG. 6A showing a state prior to returning the recording medium and FIG. 6B showing a state after returning the recording medium.
Figure 6B:
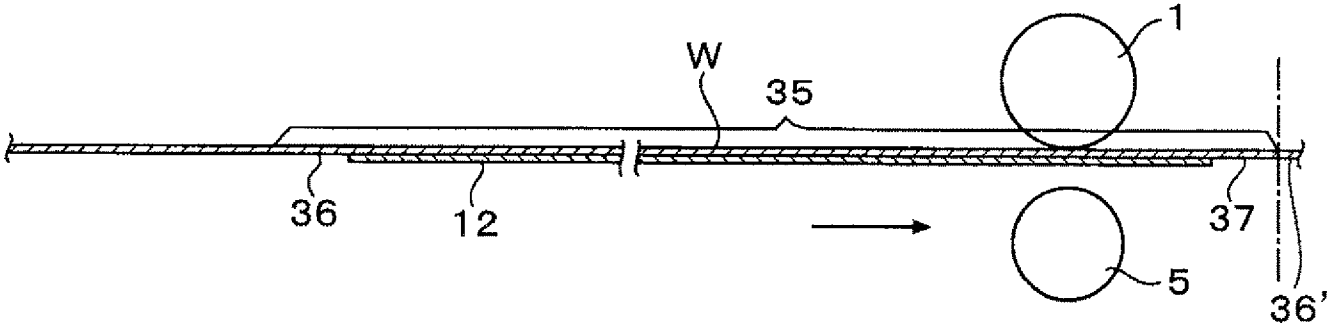

FIGS. 6A and 6B are views for explaining a return amount of the recording medium W with FIG. 6A showing a state prior to returning the recording medium W and FIG. 6B showing a state after returning the recording medium W. FIGS. 6A and 6B show a span 35 of the recording medium W in one round for the inkjet printer 33 starting conveying of the recording medium W (see point A in FIG. 5) to ending conveying of the recording medium W of the pre-applying applying apparatus 32 (see point K in FIG. 5).

Moreover, a portion 36 in which the pre-applying liquid 12 is not applied corresponds to an area surrounded by points B, C, and D after the inkjet printer 33 starts conveying the recording medium W. Furthermore, a portion 37 in which the pre-applying liquid 12 is not applied corresponds to an area surrounded by points I, J, and K immediately before conveying of the recording medium W is completed. Moreover, a portion 36' in which the pre-applying liquid 12 is not applied corresponds to an area surrounded by points B, C, and D after the conveying of the recording medium W is started at the time of the following round of applying of the pre-applying liquid 12.

As shown in FIG. 6A, in a process of transferring from completion of the one round of applying of the pre-applying liquid 12 to the following round of applying of the pre-applying liquid 12, the portion 36' and the portion 37 in which the pre-applying liquid 12 is not applied are formed such that they are continuous.

Therefore, in the present embodiment, a recording medium conveying mechanism (not shown) within the pre-applying liquid applying apparatus 32 is rotated in reverse, so that an operation of returning the recording medium W is performed such that it moves from points K to M to N to P area as shown in FIG. 5. The amount of returning of the recording medium W is at least a total amount of the "portion 37 in which the pre-applying liquid 12 is not applied that corresponds to the area surrounded by the points I, J, and K" and the "portion 36' in which the re-applying liquid 12 is not applied that corresponds to the area surrounded by the points B, C, and D".

FIG. 6B shows a state after the recording medium W is returned. Returning the recording medium W in this way makes it possible to continuously apply the pre-applying liquid 12 without a portion being formed in which the pre-applying liquid 12 is not applied when, in the following round, the pre-applying liquid 12 is applied for sending out to the inkjet printer 33 side.

Figure 7:
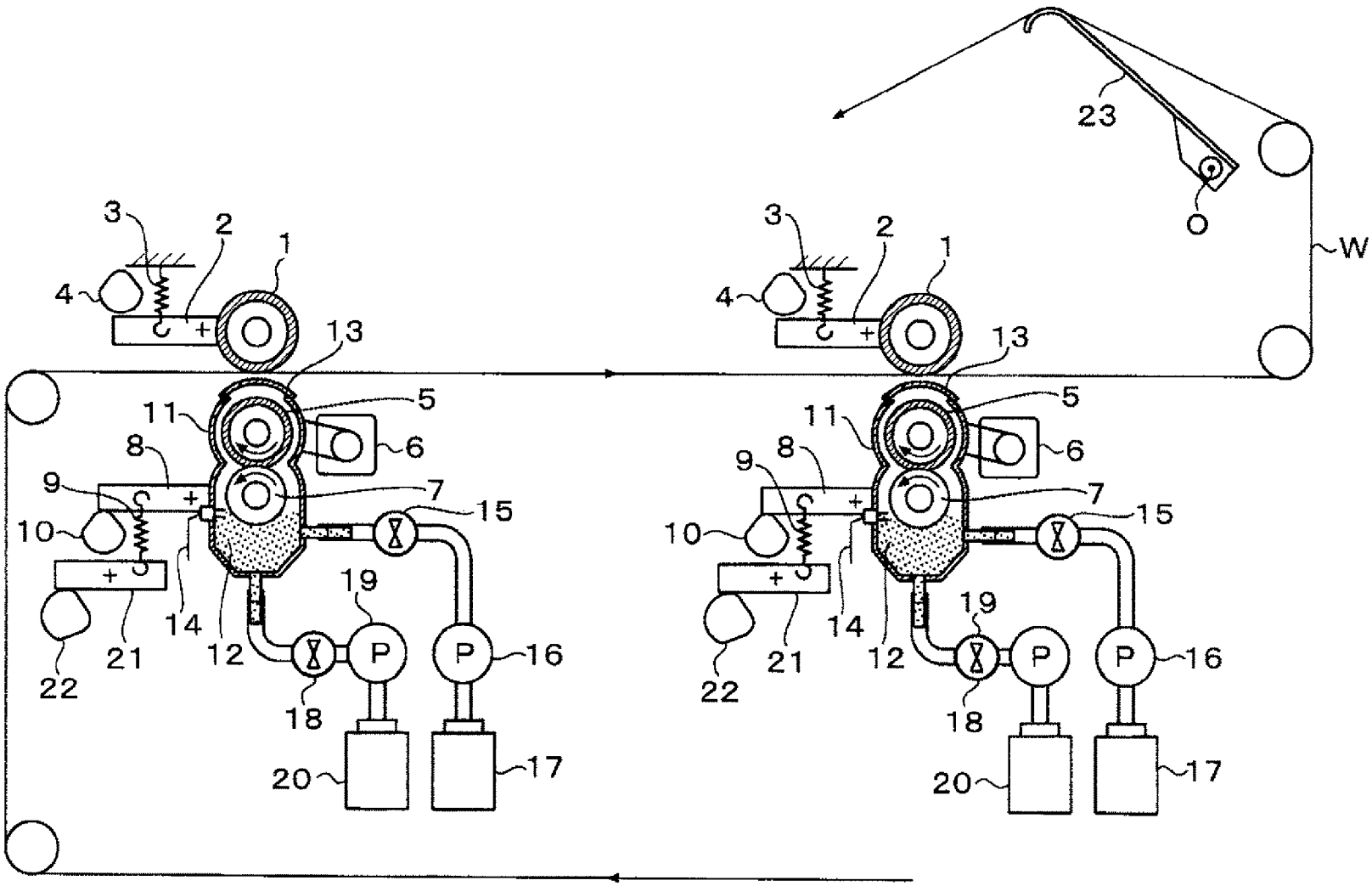
FIG. 7 is a schematic configuration diagram of the pre-applying liquid applying apparatus according to an embodiment 2 of the present invention.

FIG. 7 is a schematic configuration diagram of the pre-applying liquid applying apparatus according to an embodiment 2 of the present invention.

Figure 11:
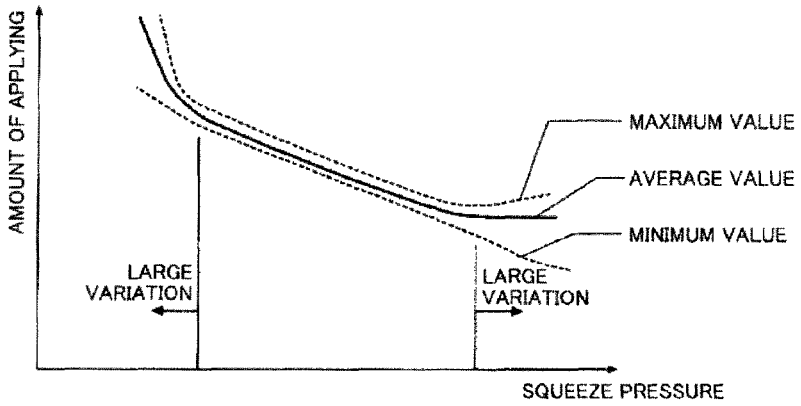
Prior Art FIG.11
FIG. 11 is a characteristic diagram showing a relationship between a load for pushing the squeeze roller against the applying roller and the pre-applying liquid amount applied onto the recording medium when the load for pushing the squeeze roller against the applying roller is changed while maintaining the surface speed of the applying roller constant.

It may be desired to use an area in which a variation is large as shown in FIG. 11 as eventually a squeeze pressure is lowered when it is necessary to apply the pre-applying liquid 12 onto the recording medium W in a large amount or when the printing speed is slow.

In order to respond to such a desire, multiple (two in the present embodiment) units of the pre-applying liquid applying apparatus described in the embodiment 1 are provided serially in a direction of conveying of the recording medium W. Then, in the present embodiment, the buffer mechanism 23 is provided on the further downstream side of the pre-applying liquid applying apparatus which is arranged on the downstream side of the conveying direction of the recording medium W.

Such an arrangement makes it possible to set a squeeze pressure to a normal region to apply the pre-applying liquid 12 in multiple rounds, thereby securing an eventual amount of applying.

While two units of the pre-applying liquid applying apparatus are provided, the present invention is not limited thereto, so that providing in serial three or more units of the pre-applying liquid applying apparatuses remarkably improves a range of applying performance of the pre-applying liquid 12.

Moreover, while one buffer mechanism 23 is provided on the further downstream side of the pre-applying liquid applying apparatus which is arranged on the downstream side in the conveying direction of the recording medium W, it is also possible to arrange the buffer mechanism 23 between the pre-applying liquid applying apparatus arranged on the upstream side and the pre-applying liquid applying apparatus arranged on the downstream side.

The present application is based on Japanese Priority Applications No. 2011-052010 filed on Mar. 9, 2011 and No. 2011-219222 filed on Oct. 3, 2011, the entire contents of which are hereby incorporated by reference.

The invention claimed is:

1. A pre-applying liquid applying apparatus for an inkjet printer, comprising:

an applying roller which applies a treatment agent onto a recording medium before an image is formed;

a squeeze roller which abuts against the applying roller; and a treatment agent supplying unit which supplies the treatment agent to a nip portion of the applying roller and the squeeze roller, wherein a squeeze pressure adjusting mechanism is provided which adjusts an abutting force of the squeeze roller against the applying roller, and wherein the squeeze pressure adjusting mechanism includes a first oscillating arm which rotatably supports the squeeze roller at one end and which includes an oscillating supporting point inside the first oscillating arm;

a second oscillating arm, one end of which is disposed close to another end of the first oscillating arm, and which second oscillating arm includes an oscillating supporting point inside he second oscillating arm;

an extension spring which is installed between the one end of the second oscillating arm and the other end of the first oscillating arm;

a cam member which is in contact with another end of the second oscillating arm;

a motor which rotationally drives the cam member; and an angular sensor which detects an oscillating angle of the second oscillating arm.

2. The pre-applying liquid applying apparatus for the inkjet printer as claimed in claim 1, wherein the abutting force of the squeeze roller due to the squeeze pressure adjusting mechanism is adjusted such that it becomes almost proportional to a conveying speed of the recording medium within the pre-applying liquid applying apparatus.

3. The pre-applying liquid applying apparatus for the inkjet printer as claimed in claim 1, wherein the recording medium is elongated, and a buffer mechanism which temporarily accumulates the recording medium is provided on a conveying path of the recording medium.

4. The pre-applying liquid applying apparatus for he inkjet printer as claim 1, wherein the treatment agent is a blur suppressing agent which suppresses an image blur onto the recording medium.

5. An image forming apparatus which is provided with a pre-applying liquid applying apparatus which applies a treatment agent onto a recording medium on the upstream side of a conveying path before image forming along the conveying path of the recording medium and which is provided with an inkjet printer which ejects ink droplets onto a treated recording medium on the downstream side of the conveying path of the recording medium of the pre-applying liquid applying apparatus to form an image, wherein the pre-applying liquid applying apparatus is the pre-applying liquid applying apparatus as claimed in claim 1.

6. The image forming apparatus as claimed in claim 5, wherein multiple units of the pre-applying liquid applying apparatus are provided serially on the conveying path of the recording medium.

7. The image forming apparatus as claimed in claim 6, wherein a buffer mechanism is provided which temporarily stores the recording medium on the downstream side of the conveying path in a recording medium conveying direction of the pre-applying liquid applying apparatus provided on the most downstream side of the recording medium conveying direction of the multiple units of the pre-applying liquid applying apparatus.

8. A pre-applying liquid applying apparatus for an inkjet printer, comprising:

an applying roller which applies a treatment agent onto a recording medium before an image is formed;

a squeeze roller which abuts against the applying roller; and a treatment agent supplying unit which supplies the treatment agent to a nip portion of the applying roller and the squeeze roller, wherein a squeeze pressure adjusting mechanism is provided which adjusts an abutting force of the squeeze roller against the applying roller, and wherein the squeeze pressure adjusting mechanism includes a first oscillating arm which rotatably supports the squeeze roller at one end and which includes an oscillating supporting point inside the first oscillating arm;

a second oscillating arm, one end of which is disposed close to another end of the first oscillating arm, and which second oscillating arm includes an oscillating supporting point inside the second oscillating arm;

an extension spring which stalled between the one end of the second oscillating arm and the other end of the first oscillating arm;

a cam member;

a motor which rotationally drives the cam member; and an angular sensor which detects an oscillating angle of the second oscillating arm.

9. An image forming apparatus which is provided with a pre-applying liquid applying apparatus which applies a treatment agent onto a recording medium on the upstream side of a conveying path before image forming along the conveying path of the recording medium and which is provided with an inkjet printer which ejects ink droplets onto a treated recording medium on the downstream side of the conveying path of the recording medium of the pre-applying liquid applying apparatus to form an image, wherein the pre-applying liquid applying apparatus is the pre-applying liquid applying apparatus as claimed in claim 8.

10. The image forming apparatus as claimed in claim 9, wherein multiple units of the pre-applying liquid applying apparatus are provided serially on the conveying path of the recording medium.

11. The image forming apparatus as claimed in claim 10, wherein a buffer mechanism is provided which temporarily stores the recording medium on the downstream side of the conveying path in a recording medium conveying direction of the pre-applying liquid applying apparatus provided on the most downstream side of the recording medium conveying direction of the multiple units of the pre-applying liquid applying apparatus.

* * * * *